US007461705B2

(12) United States Patent
Hulick et al.

(10) Patent No.: US 7,461,705 B2
(45) Date of Patent: Dec. 9, 2008

(54) DIRECTIONAL DRILLING CONTROL

(75) Inventors: Kent Erin Hulick, Houston, TX (US); David Cardellini, Spring, TX (US)

(73) Assignee: Varco I/P, Inc., Houston, TX (US)

( * ) Notice: Subject to any disclaimer, the term of this patent is extended or adjusted under 35 U.S.C. 154(b) by 35 days.

(21) Appl. No.: 11/418,843

(22) Filed: May 5, 2006

(65) Prior Publication Data

US 2007/0256863 A1 Nov. 8, 2007

(51) Int. Cl.
*E21B 44/00* (2006.01)

(52) U.S. Cl. ..... 175/24; 175/57

(58) Field of Classification Search ..... 175/61, 175/177.6, 57, 188, 24, 26
See application file for complete search history.

(56) References Cited

U.S. PATENT DOCUMENTS

| | | | | |
|---|---|---|---|---|
| 3,658,138 A | | 4/1972 | Gosselin | 173/1 |
| 3,872,932 A | | 3/1975 | Gosselin | 173/1 |
| 4,354,233 A | | 10/1982 | Zhukovsky et al. | 364/420 |
| 4,407,017 A | | 9/1983 | Zhilikov et al. | 364/420 |
| 4,591,006 A | | 5/1986 | Hutchinson et al. | 175/52 |
| 4,596,294 A | | 6/1986 | Russell | 175/74 |
| 4,604,724 A | | 8/1986 | Shaginian et al. | 364/478 |
| 4,612,987 A | | 9/1986 | Cheek | 166/212 |
| 4,748,563 A | | 5/1988 | Anthoine | 364/420 |
| 4,793,421 A | | 12/1988 | Jasinski | 175/27 |
| 4,854,397 A | | 8/1989 | Warren et al. | 175/26 |
| 4,995,465 A | | 2/1991 | Beck et al. | 175/27 |
| 5,259,468 A | * | 11/1993 | Warren et al. | 175/45 |
| 5,421,420 A | | 6/1995 | Malone et al. | 175/61 |
| 5,465,799 A | | 11/1995 | Ho | 175/61 |
| 5,503,235 A | | 4/1996 | Falgout, Sr. | 175/61 |
| 6,050,348 A | | 4/2000 | Richardson et al. | 175/26 |

(Continued)

FOREIGN PATENT DOCUMENTS

DE 1634515 8/1970

(Continued)

OTHER PUBLICATIONS

Leveraging Open Source Computer Technology to Improve Drilling Process: Research & Development: Aug. 2003: p. 38.

(Continued)

*Primary Examiner*—Jennifer H Gay
*Assistant Examiner*—Brad Harcourt
(74) *Attorney, Agent, or Firm*—Guy McClung

(57) ABSTRACT

A method for oscillating a drillstring, the drillstring extending into the earth, the drillstring having a bit on a lower end thereof, the bit for drilling into the earth, the drillstring connected to a motive apparatus, the motive apparatus for rotating the drillstring, the motive apparatus having a power output associated with rotating the drillstring, the method including, in certain aspects, determining a first amount of energy and a second amount of energy, said determining based on the power output of the motive apparatus, applying the first amount of energy to the drillstring in a first rotational direction, applying the second amount of energy to the drilling in a second rotational direction, the second rotational direction opposite to the first rotational direction, the application of both the first amount of energy and the second amount of energy not moving the bit.

20 Claims, 4 Drawing Sheets

U.S. PATENT DOCUMENTS

| | | | | |
|---|---|---|---|---|
| 6,105,690 | A | 8/2000 | Biglin, Jr. et al. | 175/48 |
| 6,176,323 | B1 | 1/2001 | Weirich et al. | 175/40 |
| 6,378,628 | B1 | 4/2002 | McGuire et al. | 175/48 |
| 6,629,572 | B2 | 10/2003 | Womer et al. | 175/219 |
| 6,719,069 | B2 | 4/2004 | Alft et al. | 175/24 |
| 6,796,390 | B1 * | 9/2004 | Bakker | 175/61 |
| 6,802,378 | B2 | 10/2004 | Haci et al. | 175/26 |
| 6,918,453 | B2 | 7/2005 | Haci et al. | 175/26 |
| 6,968,909 | B2 | 11/2005 | Aldred et al. | 175/26 |
| 6,980,929 | B2 | 12/2005 | Aronstam et al. | 702/188 |
| 7,044,239 | B2 | 5/2006 | Pinckard et al. | 175/57 |
| 7,152,696 | B2 | 12/2006 | Jones | 175/61 |
| 2002/0104685 | A1 | 8/2002 | Pinckard et al. | 175/61 |
| 2005/0230101 | A1 | 10/2005 | Zheny et al. | 166/177.6 |
| 2005/0274548 | A1 | 12/2005 | Albert et al. | |

FOREIGN PATENT DOCUMENTS

| | | |
|---|---|---|
| DE | 2817875 | 4/1978 |
| GB | 1159945 | 7/1969 |
| GB | 1291655 | 8/1970 |
| GB | 2057694 | 8/1980 |
| WO | WO 01/21929 | 3/2001 |

OTHER PUBLICATIONS

V-ICIS Driller's Workstation: Advancing the Technology of Drilling: MD TOTCO A Varco Company: 4 pp.: 1998.

Customer Profile Varco International e-Drill: MONTAVISTA Software: 2 pages: 2001.

Varco's Electronic Driller puts new levels of drilling performance and crew safety in your driller's hands Varco Systems A Varco Company: 6 pp.: 2003.

Varco's V-ICIS eD (TM)—integrated control and information at your fingertips: Varco: 4 pp.: 2001.

* cited by examiner

DIRECTIONAL DRILLING CONTROL

BACKGROUND OF THE INVENTION

1. Field of the Invention

This present invention is directed to directional drilling, systems for controlling the orientation of a drill bit during directional drilling, and, in certain particular aspects, to applying specific amounts of energy to a drillstring to prevent binding of the drillstring while maintaining bit face orientation during drilling.

2. Description of Related Art

The prior art discloses a wide variety of drilling systems, directional drilling systems, apparatuses, and methods; including, but not limited to, the disclosures in U.S. Pat. Nos. 6,944,547; 6,918,453; 6,802,378; 6,050,348; 5,465,799; 4,995,465; 4,854,397; and 3,658,138, all incorporated fully herein for all purposes.

In directional drilling target formations may be spaced laterally thousands of feet from a well's surface location requiring penetration to depth and also laterally through soil, rock, and formations.

In directional drilling a substantial length of the drillstring is in frictional contact with and supported by the borehole. Since the drillstring is not rotating, it is difficult to overcome the friction. The difficulty in overcoming the friction makes it difficult for the driller to apply sufficient weight to the bit to achieve an optimal rate of penetration. The drillstring exhibits stick/slip friction such that when a sufficient amount of weight is applied to overcome the friction, the drill the weight on bit tends to overshoot the optimum magnitude. Additionally, the reactive torque that would be transmitted from the bit to the surface through drillstring, if the hole were straight, is absorbed by the friction between the drillstring and the borehole. Thus, during drilling, there can be substantially no reactive torque at the surface. Moreover, in certain methods when the driller applies drillstring angle corrections at the surface in an attempt to correct the bit face angle, a substantial amount of the angular change is absorbed by friction without changing the face angle in stick/slip fashion. When enough angular correction is applied to overcome the friction, the face angle may overshoot its target, thereby requiring the driller to apply a reverse angular correction.

One of the challenges for directional drilling is preventing the horizontal portions of the string from binding with the surrounding rock formation and reducing sliding friction as the bit progresses through the formation. To do this it is desirable to keep as much of the horizontal portion of the string moving as fast as possible without affecting or changing the bit face orientation. The process of rotating the string alternating in direction without moving the bit is known as "wagging the dog."

In one prior method the frictional engagement between the drillstring and the borehole is reduced by rocking the drillstring back and forth between a first angle and a second angle. By rocking the string, the stick/slip friction is reduced, thereby making it easier for the driller to control the weight on bit and make appropriate face angle corrections. In another prior method a motor's shaft is rotated at a fixed speed for a specified time in each direction, effectively rotating the shaft a fixed distance.

Another prior method and system for directional drilling reduces the friction between the drillstring and the well bore by rocking the drillstring back and forth between first and second torque magnitudes. A downhole drilling motor is connected to the surface by a drillstring. The drilling motor is oriented at a selected tool face angle. The drillstring is rotated at the surface location in a first direction until a first torque magnitude is reached, without changing the tool face angle. The drillstring is then rotated in the opposite direction until a second torque magnitude is reached, again without changing the tool face angle. The drillstring is rocked back and forth between the first and second torque magnitudes.

In rotating a drillstring to overcome undesirable sticking and friction, ideally such rotation does not change the bit face orientation; but, due to the limitations of available prior art systems and methods, it is often difficult to nullify frictional effects on the drillstring without adversely changing bit face orientation.

BRIEF SUMMARY OF THE PRESENT INVENTION

The present invention discloses, in certain aspects, systems and methods for moving a bit efficiently and effectively through a formation while inhibiting or preventing binding of the drillstring on the formation and maintaining a desired bit face orientation during drilling. In certain aspects, such systems and methods reduce sliding friction of the drillstring with respect to the formation.

The present invention, in certain aspects, discloses a method for oscillating a drillstring, the drillstring extending into the earth, the drillstring having a drill bit on a lower end thereof, the drillstring connected to a motive apparatus (e.g. a rotary system, power swivel, top drive system) for rotating the drillstring, the motive apparatus having a power output associated with rotating the drillstring, the method including: determining a first amount of energy and a second amount of energy (of different or equal values), said determining based on the power output of the motive apparatus; applying the first amount of energy to the drillstring in a first rotational direction; applying the second amount of energy to the drilling in a second rotational direction, the second rotational direction opposite to the first rotational direction; and the application of both the first amount of energy and the second amount of energy not moving the bit.

In certain embodiments of the present invention a system is provided for moving a drill string, particular non-vertical portions of a drillstring, through a formation by imparting a certain desired amount of energy to the string with a top drive motor, with a rotary table, or with a power swivel to rotate the string in a first direction and then imparting a certain desired amount of energy to the string to rotate it in an opposite second direction, thereby reducing sliding friction of the string and binding of the string on the formation. As needed, continuous oscillation in one direction then the other is repeated.

The present invention, in certain aspects, discloses a system for cyclically rotating a drillstring, the drillstring having a bit at a lower end of a drillstring, the system including: motive apparatus for rotating a drillstring and a bit, the bit connected to an end of the drillstring, the drillstring in a wellbore, the wellbore extending from an earth surface into the earth, the bit at a location beneath the earth surface; a control system in communication with the motive apparatus, the control system for controlling the motive apparatus to rotate the drillstring in a first rotational direction applying a first amount of energy to the drillstring and then in a second rotational direction applying a second amount of energy to the drillstring; and said amounts of energy applied to the drillstring without moving the bit.

In one particular aspect according to the present invention the energy to be imparted to the drillstring is calculated by integrating the motor power output (angular velocity times torque) over time:

$$\text{Power}=\omega T$$

($\omega$–angular velocity $T$=torque)

$$\text{Energy}=\int \omega T dt$$

In order to allow the top drive motor to ramp its speeds properly and ensure that its drive shaft stops and reverses direction exactly when the energy limit has been reached, an angular stop position is calculated. To do this, the distance required to stop the shaft at its maximum deceleration is calculated by:

$$\theta=\omega^2/a_{max}$$

where $a_{max}$ is the acceleration limit used in the speed ramp function and $\theta$ is the angular distance (amount of shaft rotation) and $\omega$ is the angular velocity of the shaft (and, therefore, of the drillstring). The Energy added to the string during this ramp down is estimated by using a smoothed torque value (digitally filtered) and multiplying it by this angular distance. It is then determined when to begin ramping down the speed by keeping a running integral of the energy delivered to the shaft and when it is within the estimated stopping energy of the limit ramping the speed of the shaft to zero and reversing direction.

It is, therefore, an object of at least certain preferred embodiments of the present invention to provide new, useful, unique, efficient, nonobvious systems and methods, including, but not limited to: systems and methods for imparting specified amounts of energy to a drillstring and/or for oscillating a drillstring, first in one direction then in an opposite direction; in certain aspects to reduce binding against a formation and/or to reduce sliding friction.

Certain embodiments of this invention are not limited to any particular individual feature disclosed here, but include combinations of them distinguished from the prior art in their structures, functions, and/or results achieved. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the problems and needs in this area and provides a solution to those problems and a satisfactory meeting of those needs in its various possible embodiments and equivalents thereof. To one of skill in this art who has the benefits of this invention's realizations, teachings, disclosures, and suggestions, other purposes and advantages will be appreciated from the following description of certain preferred embodiments, given for the purpose of disclosure, when taken in conjunction with the accompanying drawings. The detail in these descriptions is not intended to thwart this patent's object to claim this invention no matter how others may later attempt to disguise it by variations in form, changes, or additions of further improvements.

The Abstract that is part hereof is to enable the U.S. Patent and Trademark Office and the public generally, and scientists, engineers, researchers, and practitioners in the art who are not familiar with patent terms or legal terms of phraseology to determine quickly from a cursory inspection or review the nature and general area of the disclosure of this invention. The Abstract is neither intended to define the invention, which is done by the claims, nor is it intended to be limiting of the scope of the invention in any way.

It will be understood that the various embodiments of the present invention may include one, some, or all of the disclosed, described, and/or enumerated improvements and/or technical advantages and/or elements in claims to this invention.

BRIEF DESCRIPTION OF THE SEVERAL VIEWS OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

DETAILED DESCRIPTION OF THE INVENTION

Figure 1:
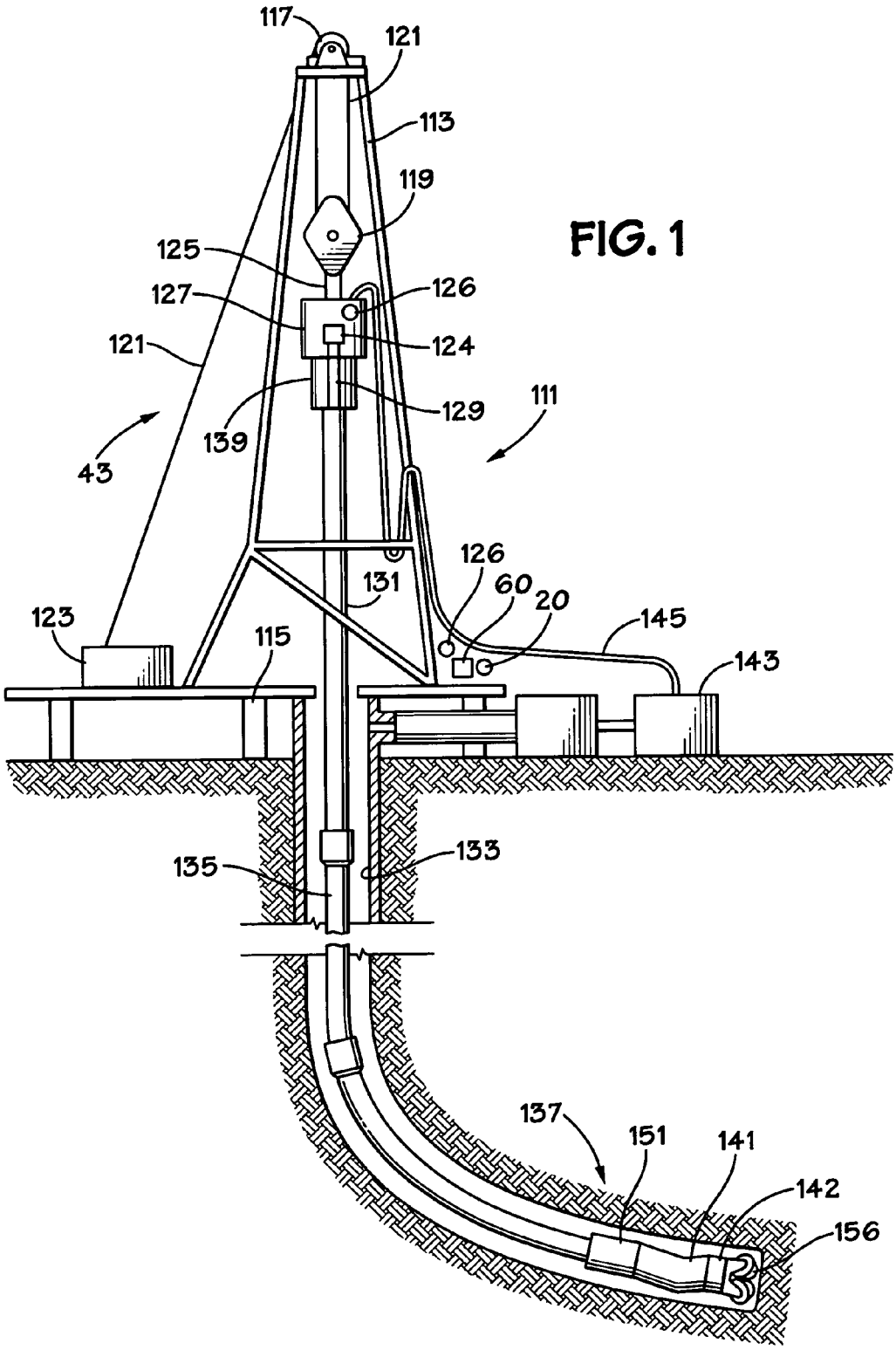
FIG. 1 is a schematic view of a system according to the present invention.

Referring now to FIG. 1, a drilling rig 111 is depicted schematically as a land rig, but other rigs (e.g., offshore rigs, jack-up rigs, semisubmersibles, drill ships, and the like) are within the scope of the present invention. In conjunction with an operator interface, e.g. an interface 20, a control system 60 as described below controls certain operations of the rig. The rig 111 includes a derrick 113 that is supported on the ground above a rig floor 115. The rig 111 includes lifting gear, which includes a crown block 117 mounted to derrick 113 and a traveling block 119. A crown block 117 and a traveling block 119 are interconnected by a cable 121 that is driven by drawworks 123 to control the upward and downward movement of the traveling block 119. Traveling block 119 carries a hook 125 from which is suspended a top drive system 127 which includes a variable frequency drive controller 126, a motor (or motors) 124 and a drive shaft 129. The top drive system 127 rotates a drillstring 131 to which the drive shaft 129 is connected in a wellbore 133. The top drive system 127 can be operated to rotate the drillstring 131 in either direction. According to an embodiment of the present invention, the drillstring 131 is coupled to the top drive system 127 through an instrumented sub 139 which includes sensors that provide information, e.g., drillstring torque information.

The drillstring 131 may be any typical drillstring and, in one aspect, includes a plurality of interconnected sections of drill pipe 135 a bottom hole assembly (BHA) 137, which includes stabilizers, drill collars, and/or an apparatus or device, in one aspect, a suite of measurement while drilling (MWD) instruments including a steering tool 151 to provide bit face angle information. Optionally a bent sub 141 is used with a downhole or mud motor 142 and a bit 156, connected to the BHA 137. As is well known, the face angle of the bit 156 is controlled in azimuth and pitch during drilling.

Drilling fluid is delivered to the drillstring 131 by mud pumps 143 through a mud hose 145. During rotary drilling, drillstring 131 is rotated within bore hole 133 by the top drive system 127 which, in one aspect, is slidingly mounted on parallel vertically extending rails (not shown) to resist rotation as torque is applied to the drillstring 131. During sliding drilling, the drillstring 131 is held in place by top drive system 127 while the bit 156 is rotated by the mud motor 142, which is supplied with drilling fluid by the mud pumps 143. The driller can operate top drive system 127 to change the face angle of the bit 156.

Although a top drive rig is illustrated, it is within the scope of the present invention for the present invention to be used in connection with systems in which a rotary table and kelly are used to apply torque to the drillstring.

The cuttings produced as the bit drills into the earth are carried out of bore hole 133 by drilling mud supplied by the mud pumps 143.

Figure 2:
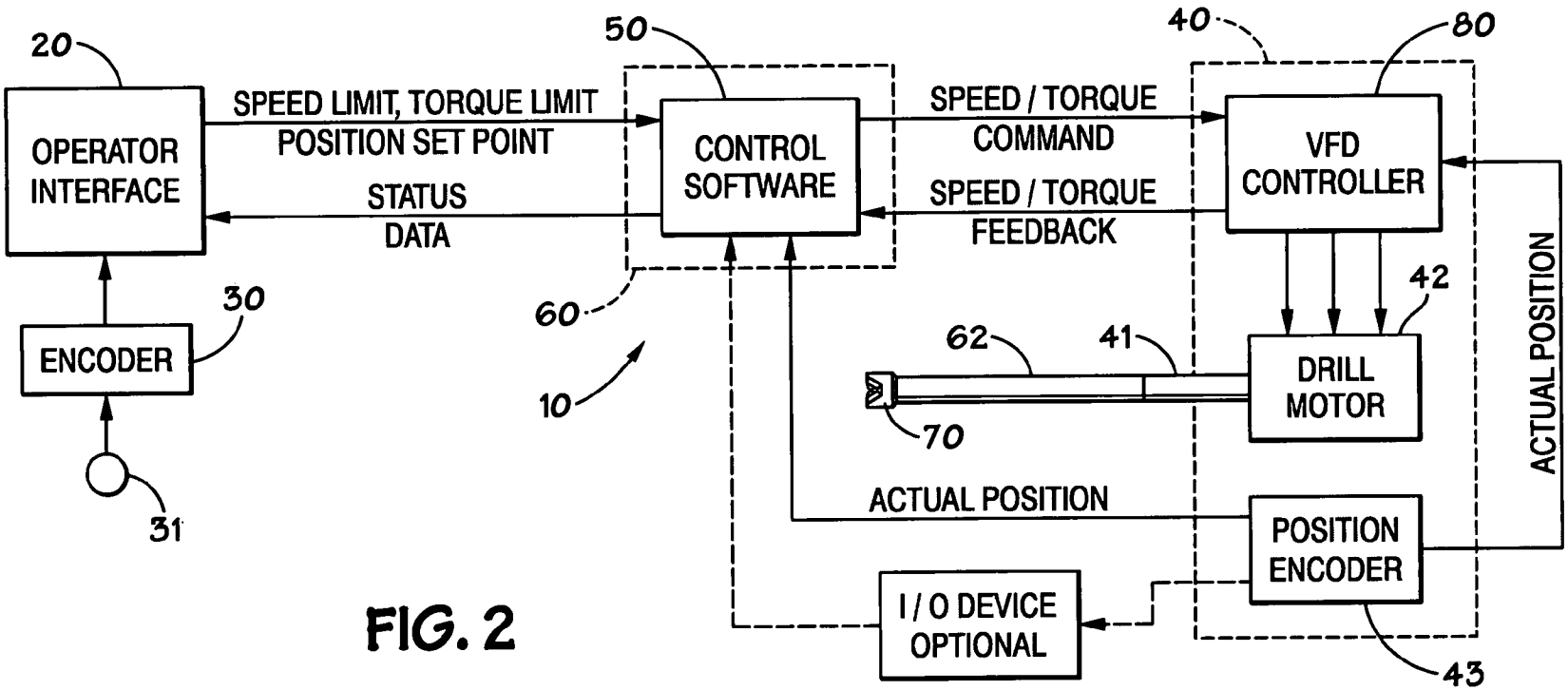
FIG. 2 is a schematic view of a system according to the present invention.

As shown in FIG. 2, a system 10 according to the present invention has an operator interface 20 (e.g., but not limited to, a driller's console and/or one, two, three or more touch screens and/or joystick((s)), slider((s)) or knob((s))) with an optional adjustable encoder 30 for rotating a main shaft 41 of a top drive system 40 (like the system 127, FIG. 1). The adjustable encoder 30 has adjustable apparatus 31 (e.g. a rotatable knob or a movable slider), which, when moved or rotated by the driller or other personnel results in a corresponding movement of the main shaft 41 (like the shaft 129, FIG. 1) of the top drive system 40 and, therefore, of the drillstring and attached bit (as in FIG. 1).

Control software 50 in a programmable medium of the control system 60, e.g., but not limited to, one, two, three or more on-site, or remote computers, PLC's, single board computer(s), CPU(s), finite state machine(s), microcontroller(s), controls the movement of the main shaft 41 in response to the movement of the adjustable apparatus 31 (e.g. at a driller's console) so that the main shaft 41 is not moved too quickly and so that it and a drillstring 62 (like the drillstring 131, FIG. 1) and a bit 70 connected thereto (like the bit 156, FIG. 1) are moved smoothly with a smoothly decreasing declaration as a movement end point is approached. "On-site" may include e.g., but is not limited to, in a driller's cabin and/or in a control room or building adjacent a rig.

A motor 42 of the top drive system 40 rotates the main shaft 41 (which is connected to the drillstring 62) with the drill bit 70 at its end. A VFD controller 80 (like the controller 126, FIG. 1) controls the motor 42. A position encoder 43 (located adjacent the top drive motor) sends a signal indicative of the actual position of the main shaft 41 to the VFD controller 80 and to the control system 60 where it is an input value for the control software 50.

From the operator interface 20, pre-selected limiting values for main shaft speed ("speed limit"); main shaft torque ("torque limit"); and a desired bit position or "Position Set Point" are input to the control system's control software 50. The control system 60 provides status data to the operator interface 20 which includes speed, torque, shaft orientation, and position of the apparatus 31.

The control software 50 sends commands to the VFD controller 80 which include speed commands and torque commands (torque limit). The VFD controller 80 provides feedback to the control software 50 which includes values for actual speed of the main shaft 41 and the actual torque (the torque applied to the drillstring by the top drive motor).

Figure 3:
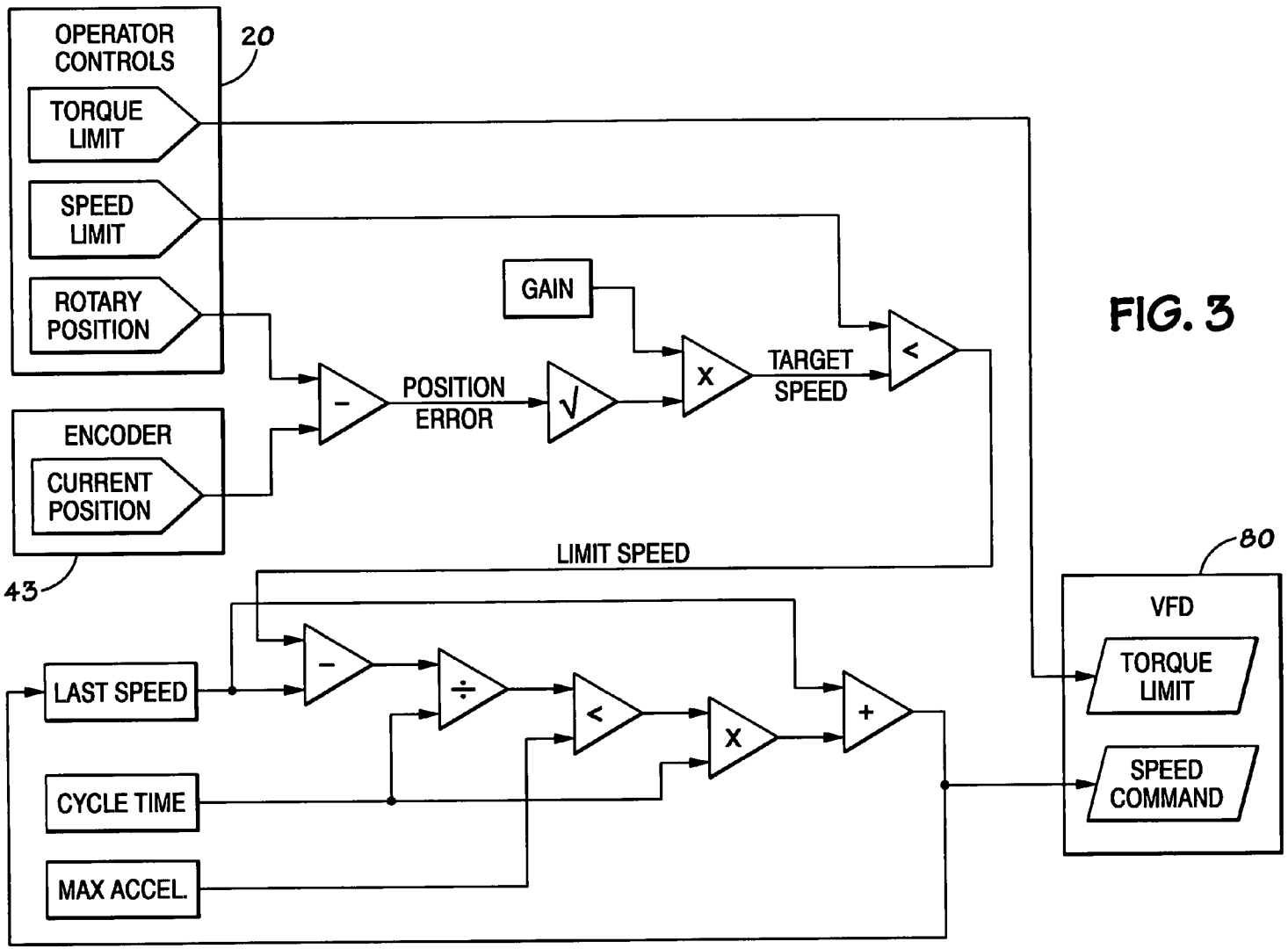
FIG. 3 is a schematic view of a functions of the system of FIG. 2 according to the present invention.

FIG. 3 illustrates functioning of the system 10.

As shown in FIG. 3, the control system 60 then adjusts the speed of the top drive motor and controls the torque applied to the drillstring so that the main shaft of the top drive stops at a desired point. The control system conveys to the control software data values (e.g. fifty per second) for the amount of torque actually applied to the string; and, regarding actual speed, the amount of actual rotation of the string (in degrees or radians). The position encoder 43 has provided position information and velocity information to the VFD controller 80. The control software 50 receives information regarding position from the encoder 43 and/or from the VFD controller 80 or, optionally, through a direct input/output apparatus (e.g. an I/O device in communication with the encoder) controlled by the software 50. The VFD controller 80 constantly uses the position from the encoder 43 to control outputs of the top drive motor to achieve the desired commanded speed and to maintain torque within the torque limit imposed by the control software 50.

The operator using the operator controls on the control interface 20 inputs to the VFD controller 80 a limitation on the torque that is to be applied to the string ("Torque Limit") and a limitation on the speed at which the main shaft 41 of the top drive system 40 is to be rotated ("Speed Limit").

Using the Speed Limit, the actual position of the main shaft, the last speed at which the main drive shaft was rotating ("Last Speed"), the speed commanded by the control system 60, to the VFD controller 80 from the previous control iteration), the maximum allowable acceleration ("Max Accel"), and the cycle time for sending speed commands to the VFD controller 80 (cycle time is provided by a hardware clock, a clock in a CPU, or a clock in the control system 60), the control software 50 calculates a speed command ("Speed Command") which is sent to the VFD controller 80 which, in turn, controls the rotation of the main shaft 41 so that the drillstring is rotated at the desired speed. To re-orient a bit, it is desirable to rotate the string at such a speed that the bit neither overshoots nor undershoots a desired position (orientation) and this is achieved by rotating as quickly as possible; but as the bit approaches the desired position, it is important to decelerate so that overshoot does not occur. Thus, the control software 50 calculates desired speed for the entire period of bit movement and desired speed changes as the bit approaches a desired position. A final speed is such a calculated speed for rotation of the string as the bit nears the desired position.

The VFD controller 80 receives commands from the operator interface 20 so that the VFD controller follows (performs correspondingly to) the adjustable encoder 30. The change of position of the adjustable encoder 30 is monitored by the control software 50 and the difference between the two positions (position indicated by the encoder 30 minus the position indicated by the encoder 43); (position of the encoder 43 divided by the gear ratio of the top drive, the ratio between the rotation of the drill motor to the rotation of the shaft, e.g., but not limited to 10:1, for example, with a gear ratio of 10:1 the encoder 43 moves ten times as much as the encoder 30) is calculated resulting in an amount to move the encoder 30 ("Position Error"). The square root of the position error times a gain factor ("gain") yields a "Target Speed" which is further processed to determine a momentary speed ("Limit Speed") of rotation of the drillstring to arrive quickly and smoothly at a desired bit orientation/location.

The Last Speed is subtracted from the lesser of the Target Speed and an operator-entered speed limit and the resulting difference is divided by the cycle time to give the needed shaft acceleration. The lesser of this calculated acceleration and the acceleration limit (parameter) is multiplied by the cycle time to give a differential speed which is then added to the Last Speed and sent to the VFD controller 80 as the new speed command.

Figure 4:
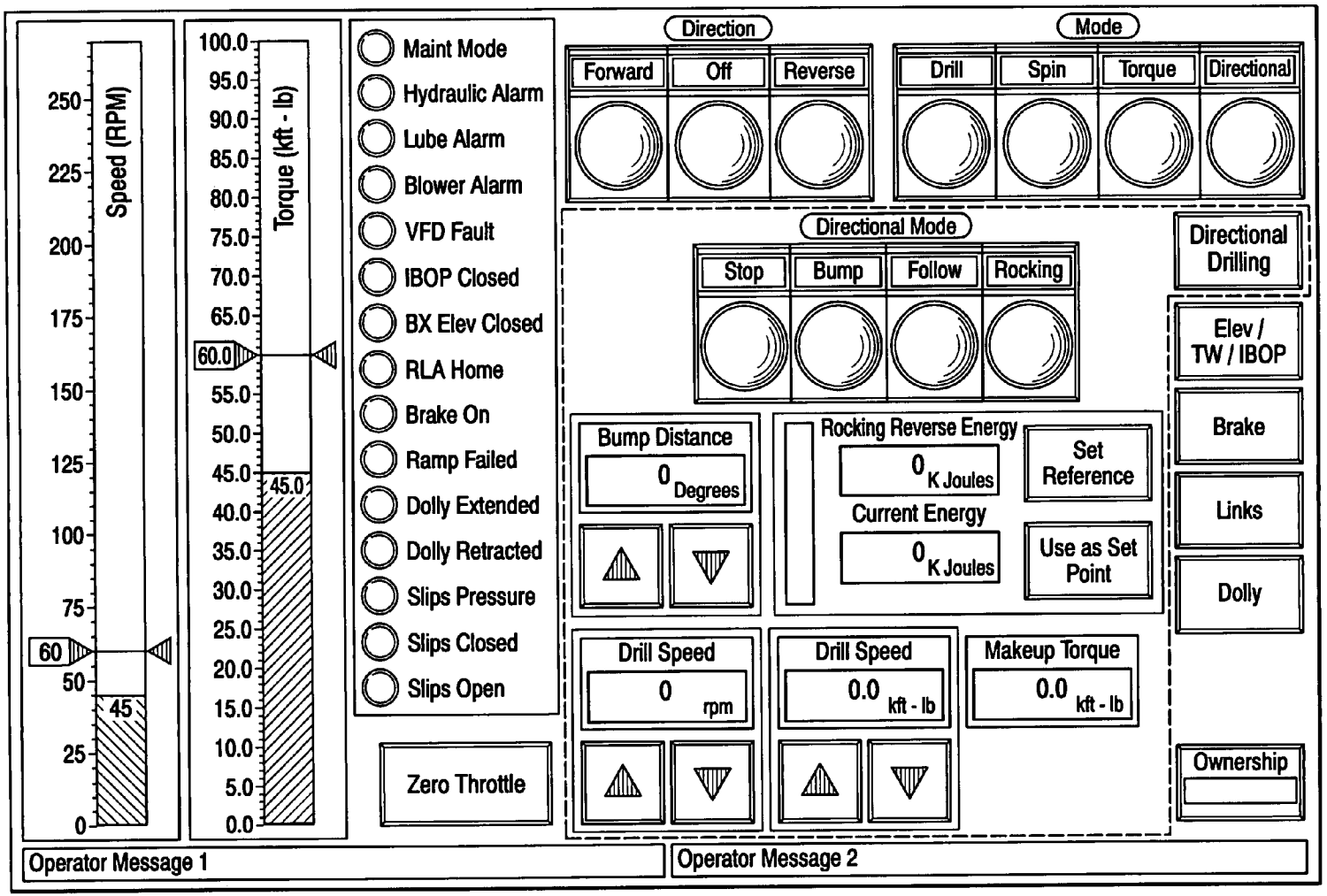
FIG. 4 is a schematic view of a touch screen usable in certain embodiments of the present invention.

FIG. 4 shows an operator's console, e.g. a touch screen, according to the present invention useful with a control system as described above; e.g., for operating in a bump mode, a follow mode, or a "wag-the-dog" mode for oscillating ("rocking") a drill string according to methods of the present invention. But for the "buttons" or areas to be activated by an operator on the touch screen within the dotted line, including the button labelled "Directional Drilling," the screen would be a screen as used in a prior art console used, e.g., in a prior art AMPHION™ system commercially available from National Oilwell Varco. After pushing the "Directional" button, when the "Directional Drilling" button is pushed, the remainder of the buttons within the dotted line appear and an operator can then select to stop—"Stop"—rotation of the drillstring; to move the drillstring (and, therefore, the bit) in bump—"Bump"—mode; to move the drillstring in correspondence to operator movement of a control member (e.g. knob or slider)—"Follow" mode; or to oscillate part of the drillstring to inhibit binding of the drillstring—in "Rocking" mode. Optionally, instead of a single "Bump" button, two buttons may be used—one for "Bump" clockwise and one for "Bump" counterclockwise.

In order to proceed in "Rocking" mode, an operator first defines a reference value (a start value) for energy being applied to the drillstring. To do this, the "Set Reference" button is pushed which causes the control system to zero the calculated applied energy, which actually sums for that moment the energy being applied to the drillstring. The control system also stores a physical location at that point of the drillstring and, therefore, of the bit, as indicated by the encoder apparatus (e.g. like the encoder apparatus 43 described above).

The operator then rotates the drillstring (using normal controls and rotating normally; in "Bump" mode; or in "Follow" mode) in a first direction to a new first position as compared to the reference position. The control system's computer functions calculate how much energy was applied to the drillstring to reach the new first position. This amount of energy is displayed as "Current Energy." The operator then pushes the "Use as Set Point" button to store the "Current Energy" as the new reversing energy setpoint (the amount of energy to be applied to rotate the drillstring in a second direction opposite to the first direction). Then the operator pushes the "Rocking" button and the control system initiates rotational movement of the drillstring in the second direction. When the applied energy equals the rocking reverse energy setpoint value, the control system stops the rotation and then again rotates back to the reference position. Then with the bit at the reference position the control system begins calculating the energy as it rotates the bit past the reference position and rotates the shaft to the extent that the applied energy is equal to the rocking reverse energy. When this amount of energy has been applied, the system rotates the shaft in the opposite direction. This results in the drillstring achieving a new second position. Then the control system rotates the drillstring from the new second position back to the new first position at which the control system automatically again zeroes the applied energy, updates the calculation of the value of the energy applied to achieve the rocking reverse energy value, and then rotates the drillstring in the opposite direction. This cycle is then repeated to rock the drillstring back and forth in a desired oscillatory mode. The control system moves the drillstring in each oscillation in accordance with a calculated amount of applied energy (which is not based on calculations based on or the use of the actual physical position of the shaft, bit or drillstring). The drillstring is stopped in each oscillation when the calculated amount of energy has been applied, no matter where the bit is located.

Filed on even date herewith and incorporated fully herein for all purposes is the co-owned U.S. patent application entitled "Bit Face Orientation Control In Drilling Operations" naming Kent Erin Hulick as inventor.

The present invention, therefore, in at least one or certain embodiments provides a method for oscillating a drillstring, the drillstring extending into the earth, the drillstring having a bit on a lower end thereof, the bit for drilling into the earth, the drillstring connected to a motive apparatus, the motive apparatus for rotating the drillstring, the motive apparatus having a power output associated with rotating the drillstring, the method including: determining a first amount of energy and a second amount of energy, said determining based on the power output of the motive apparatus; applying the first amount of energy to the drillstring in a first rotational direction; applying the second amount of energy to the drilling in a second rotational direction, the second rotational direction opposite to the first rotational direction; the application of both the first amount of energy and the second amount of energy not moving the bit. Such a method may include one or some, in any possible combination, of the following: wherein the motive apparatus is a top drive system, a power swivel, or a rotary system for rotating the drillstring; continuously oscillating the drillstring cyclically in the first rotational direction then in the second rotational direction by applying amounts of energy to the drillstring, said applications of amounts of energy to the drillstring not moving the bit; wherein the top drive system has a top drive shaft and is driven by a variable frequency drive, and a control system in communication with the top drive system and the variable frequency drive controls the variable frequency drive, the variable frequency drive providing feedback to the control system regarding angular velocity of the top drive shaft and torque applied to the top drive shaft by the top drive system, the method further including the control system calculating amounts of energy imparted to the drillstring by the top drive system based on the feedback from the variable frequency drive; wherein a control system in communication with and controlling the motive apparatus controls the motive apparatus to rotate the drillstring; wherein the control system includes control apparatus containing programmable media, the control apparatus from the group consisting of computer, programmable logic controller, single board computer, central processing unit, microcontroller, and finite state machine; wherein the control system is in communication with an operator interface for an operator to initiate the control system calculating an amount of energy applied to the drillstring by the motive apparatus to move the drillstring in a first rotational direction to a first position, the method further including initiating calculation of the amount of energy applied to the drillstring to move it to the first position, rotating the drillstring from the first position in a second rotational direction to a second position, calculating an amount of energy applied to move the drillstring to the second position, and applying a new amount of energy to the drillstring to move in the first rotational direction the drillstring to a third position; wherein the drillstring includes a mud motor for rotating the bit, the method further including rotating the bit with the mud motor; determining a start reference value for energy applied to the drillstring prior to application of the first amount of energy, and determining a reference position which is the position of the drillstring prior to application of the first amount of energy to the drillstring; calculating a new applied energy applied to the drillstring following each application of an amount of energy applied to the drillstring, and based on said new applied energy, applying a further amount of energy to the drillstring in a direction opposite to the direction in which the new amount of energy was applied to the drillstring; stopping rotation of the drillstring in the first rotational direction when the first amount of energy has been applied to the drillstring; stopping rotation of the drillstring in the rotational direction in which it is rotating following application of the new amount of energy to the drillstring; wherein the amounts of energy are applied by a rotary system; and/or wherein the amounts of energy are applied by a power swivel.

The present invention, therefore, in at least one or certain embodiments provides a method for oscillating a drillstring with a top drive system, the drillstring extending into the earth, the drillstring having a bit on a lower end thereof, the bit for drilling into the earth, the method including: applying the first amount of energy to the drillstring in a first rotational direction; applying the second amount of energy to the drilling in a second rotational direction, the second rotational direction opposite to the first rotational direction; the application of both the first amount of energy and the second amount of energy not moving the bit; continuously oscillating the drillstring cyclically in the first rotational direction then in the second rotational direction by applying additional amounts of energy to the drillstring, said applications of additional amounts of energy to the drillstring not moving the bit; wherein the top drive system has a top drive shaft and is driven by a variable frequency drive, and a control system in communication with the top drive system and the variable frequency drive controls the variable frequency drive, the variable frequency drive providing feedback to the control system regarding angular velocity of the top drive shaft and torque applied to the top drive shaft by the top drive system; the control system calculating amounts of energy imparted to the drillstring by the top drive system based on the feedback from the variable frequency drive; and wherein the control system includes control apparatus containing programmable media, the control apparatus from the group consisting of computer, programmable logic controller, single board computer, central processing unit, microcontroller, and finite state machine. Such a method may include one or some, in any possible combination, of the following: determining a start reference value for energy applied to the drillstring prior to application of the first amount of energy, and determining a reference position which is the position of the drillstring prior to application of the first amount of energy to the drillstring; calculating a further amount energy to be applied to the drillstring following each application of an amount of energy applied to the drillstring, and applying the further amount of energy to the drillstring in a direction opposite to the direction in which a previous amount of energy was applied to the drillstring; and/or stopping rotation of the drillstring in the rotational direction in which it is rotating following application of each further amount of energy to the drillstring.

The present invention, therefore, in at least one or certain embodiments provides a system for cyclically rotating a drillstring, the drillstring having a bit at a lower end of a drillstring, the system including: motive apparatus for rotating a drillstring and a bit, the bit connected to an end of the drillstring, the drillstring in a wellbore, the wellbore extending from an earth surface into the earth, the bit at a location beneath the earth surface; a control system in communication with the motive apparatus, the control system for controlling the motive apparatus to rotate the drillstring in a first rotational direction applying a first amount of energy to the drillstring and then in a second rotational direction applying a second amount of energy to the drillstring; and said amounts of energy applied to the drillstring without moving the bit.

In conclusion, therefore, it is seen that the present invention and the embodiments disclosed herein are well adapted to carry out the objectives and obtain the ends set forth. Certain changes can be made in the subject matter without departing from the spirit and the scope of this invention. It is realized that changes are possible within the scope of this invention and it is further intended that each element or step recited herein is to be understood as referring to the step literally and/or to all equivalent elements or steps. This specification is intended to cover the invention as broadly as legally possible in whatever form it may be utilized. All patents and applications identified herein are incorporated fully herein for all purposes.

What is claimed is:

1. A method for oscillating a drillstring, the drillstring extending into the earth, the drillstring having a bit on a lower end thereof, the bit for drilling into the earth, the drillstring connected to a motive apparatus, the motive apparatus for rotating the drillstring, the motive apparatus having a power output associated with rotating the drillstring, the method comprising determining a first amount of energy and a second amount of energy, said determining including calculating the first amount of energy and the second amount of energy based on actual movement of the drillstring by a motive apparatus, the first amount of energy based on a measured amount of energy applied to the drillstring to move the drillstring to a first position, and the second amount of energy based on a measured amount of energy applied to the drillstring to move the drillstring to a second position, the second position subsequent to the first position, said calculating not based on an actual physical position of the drillstring and not based on an actual physical position of the bit, applying the first amount of energy to the drillstring in a first rotational direction to move the drillstring to the first position, stopping the drillstring at the first position without regard to location of the bit, after applying the first amount of energy to the drillstring applying the second amount of energy to the drilling in a second rotational direction, the second rotational direction opposite to the first rotational direction, and stopping the drillstring at the second position without regard to location of the bit, said oscillating accomplished without rotating the drillstring a predetermined angle.

2. The method of claim 1 wherein the application of both the first amount of energy and the second amount of energy do not move the bit.

3. The method of claim 1 wherein the motive apparatus is a top drive system connected to the drillstring.

4. The method of claim 1 further comprising continuously oscillating the drillstring cyclically in the first rotational direction then in the second rotational direction by applying amounts of energy to the drillstring, each of said amounts of energy determined based on measured amounts of energy for moving the drillstring to a position.

5. The method of claim 3 wherein the top drive system has a top drive shaft and is driven by a variable frequency drive, and a control system in communication with the top drive system and the variable frequency drive controls the variable frequency drive, the variable frequency drive providing feedback to the control system regarding angular velocity of the top drive shaft and torque applied to the top drive shaft by the top drive system, the method further comprising the control system calculating amounts of energy imparted to the drillstring by the top drive system based on the feedback from the variable frequency drive.

6. The method of claim 1 wherein a control system in communication with and controlling the motive apparatus controls the motive apparatus to rotate the drillstring.

7. The method of claim 6 wherein the control system includes control apparatus containing programmable media, the control apparatus from the group consisting of computer, programmable logic controller, single board computer, central processing unit, microcontroller, and finite state machine.

8. The method of claim 6 wherein the control system is in communication with an operator interface for an operator to initiate the control system calculating an amount of energy applied to the drillstring by the motive apparatus to move the drillstring in a first rotational direction to a first position, the method further comprising initiating calculation of the amount of energy applied to the drillstring to move it to the first position, rotating the drillstring from the first position in a second rotational direction to a second position, calculating an amount of energy applied to move the drillstring to the second position, and applying a new amount of energy to the drillstring to move in the first rotational direction the drillstring to a third position.

9. The method of claim 1 wherein the drillstring includes a mud motor for rotating the bit, the method further comprising rotating the bit with the mud motor.

10. The method of claim 1 further comprising determining a start reference value for energy applied to the drillstring prior to application of the first amount of energy, and determining a reference position which is the position of the drillstring prior to application of the first amount of energy to the drillstring.

11. The method of claim 4 further comprising calculating a new applied energy applied to the drillstring following each application of an amount of energy applied to the drillstring, and based on said new applied energy, applying a further amount of energy to the drillstring in a direction opposite to the direction in which the new amount of energy was applied to the drillstring.

12. The method of claim 1 further comprising stopping rotation of the drillstring in the first rotational direction when the first amount of energy has been applied to the drillstring.

13. The method of claim 11 further comprising stopping rotation of the drillstring in the rotational direction in which it is rotating following application of the new amount of energy to the drillstring.

14. The method of claim 1 wherein the amounts of energy are applied by a rotary system.

15. The method of claim 1 wherein the amounts of energy are applied by a power swivel.

16. A method for oscillating a drillstring with a top drive system, the drillstring extending into the earth, the drillstring having a bit on a tower end thereof, the bit for drilling into the earth, the method comprising determining a first amount of energy and a second amount of energy, said determining including calculating the first amount of energy and the second amount of energy based on actual movement of the drillstring by a motive apparatus, the first amount of energy based on a measured amount of energy applied to the drillstring to move the drillstring to a first position, and the second amount of energy based on a measured amount of energy applied to the drillstring to move the drillstring to a second position, the second position subsequent to the first position, said calculating not based on an actual physical position of the drillstring and not based on an actual physical position of the bit, applying the first amount of energy to the drillstring in a first rotational direction to move the drillstring to the first position, stopping the drillstring at the first position without regard to location of the bit, after applying the first amount of energy to the drillstring applying the second amount of energy to the drilling in a second rotational direction, the second rotational direction opposite to the first rotational direction, and stopping the drillstring at the second position without regard to location of the bit, said oscillating accomplished without rotating the drillstring a predetermined angle, continuously oscillating the drillstring cyclically in the first rotational direction then in the second rotational direction by applying additional amounts of energy to the drillstring, said applications of additional amounts of energy to the drillstring not moving the bit, wherein the top drive system has a top drive shaft and is driven by a variable frequency drive, and a control system in communication with the top drive system and the variable frequency drive controls the variable frequency drive, the variable frequency drive providing feedback to the control system regarding angular velocity of the top drive shaft and torque applied to the top drive shaft by the top drive system, the method further comprising the control system calculating amounts of energy imparted to the drillstring by the top drive system based on the feedback from the variable frequency drive, and wherein the control system includes control apparatus containing programmable media, the control apparatus from the group consisting of computer, programmable logic controller, single board computer, central processing unit, microcontroller, and finite state machine.

17. The method of claim 16 further comprising determining a start reference value for energy applied to the drillstring prior to application of the first amount of energy, and determining a reference position which is the position of the drillstring prior to application of the first amount of energy to the drillstring.

18. The method of claim 16 further comprising calculating a further amount energy to be applied to the drillstring following each application of an amount of energy applied to the drillstring, and applying the further amount of energy to the drillstring in a direction opposite to the direction in which a previous amount of energy was applied to the drillstring.

19. The method of claim 18 further comprising stopping rotation of the drillstring in the rotational direction in which it is rotating following application of each further amount of energy to the drillstring.

20. A system for cyclically rotating a drillstring, the drillstring having a bit at a lower end of a drillstring, the system comprising motive apparatus for rotating a drillstring and a bit, the bit connected to an end of the drillstring, the drillstring in a wellbore, the wellbore extending from an earth surface into the earth, the bit at a location beneath the earth surface, a control system in communication with the motive apparatus, the control system for controlling the motive apparatus to rotate the drillstring in a first rotational direction applying a first amount of energy to the drillstring and then in a second rotational direction applying a second amount of energy to the drillstring, said control system for controlling the motive apparatus to rotate the drillstring without rotating the drillstring a predetermined angle, said amounts of energy determined based on measured amounts of energy applied to the drillstring to move it from an initial position to a subsequent position, said amounts of energy determined without regard to an actual physical location of the drillstring and without regard to an actual physical location of the bit.

* * * * *